US006116577A

United States Patent [19]

McCanse

[11] Patent Number: 6,116,577

[45] Date of Patent: Sep. 12, 2000

[54] SERVICE LIFT WITH CURVED MAST

[75] Inventor: James Edson McCanse, Oregon, Ill.

[73] Assignee: McCanse Engineering, L.L.C., Oregon, Ill.

[21] Appl. No.: 09/338,681

[22] Filed: Jun. 23, 1999

[51] Int. Cl.[7] ..... B66F 5/04

[52] U.S. Cl. ..... 254/2 B

[58] Field of Search ..... 254/2 B, 2 R, 254/3 B, 3 R, 4 B, 4 R, 5 B, 5 R, 6 B, 6 R, 7 B, 7 R, 8 B, 8 R, 124, 89 H

[56] References Cited

U.S. PATENT DOCUMENTS

| | | | |
|---|---|---|---|
| 2,909,358 | 10/1959 | Southerwick | 254/2 B |
| 3,315,571 | 4/1967 | Hott et al. | 254/2 B |
| 3,962,737 | 6/1976 | James | 254/7 R |
| 4,506,866 | 3/1985 | Horn | 254/2 B |
| 5,339,926 | 8/1994 | McCanse et al. . | |
| 5,358,217 | 10/1994 | Dach | 254/2 R |
| 5,632,475 | 5/1997 | McCanse . | |

*Primary Examiner*—Robert C. Watson

*Attorney, Agent, or Firm*—James T. FitzGibbon; Vedder, Price, Kaufman & Kammholz

[57] ABSTRACT

A lift assembly for use in a repair shop or the like. The assembly includes at least one mast extending generally vertically, and a relatively movable component including a lift frame assembly. The lift frame assembly includes at least one longitudinal member and at least one work-engaging member. A vertically movable lifting assembly is also provided, which includes a movable element. The lift frame is movably secured to the mast by at least one guide assembly which moves substantially vertically along the track of said mast. The mast includes a portion with a slight curve or straight section inclined in the direction away from said fork leg while the curved or other mast allows free but confined movement of said guide assembly as said lift frame travels vertically throughout a range of vertical positions.

15 Claims, 4 Drawing Sheets

SERVICE LIFT WITH CURVED MAST

BACKGROUND OF THE INVENTION

This invention relates generally to service lifts, and more particularly, to service lifts of a particular configuration. By a service lift is meant a lift for vehicles such as garden tractors, golf carts, or the like, or optionally, larger vehicles such as automobiles or light trucks.

These vehicles are lifted to a level wherein the serviceman can gain convenient access to the underside of the vehicle for purpose of service, maintenance, or repair. While generally used with smaller vehicles such as garden tractors or golf carts, a suitably sized, heavy duty lift can also lift small or medium size automobiles for maintenance, service, or repair. Furthermore, it is also conceivable that such lifts may serve as a storage site for one vehicle, such as a car, atop the space normally occupied by another vehicle, assuming there is sufficient height in a garage or other storage facility to permit such lifting or "double decking".

Referring again to the use of the lift for servicing purposes, it is quite common, in the event of lifting a vehicle of rather large size, for the fork legs to deflect to a considerable extent. In this case, while there is absolutely no danger of the forks failing, or the vehicle sliding laterally from the lift, (provided of course, that it is used within its load rating,) there is a noticeable and sometimes severe reluctance on the part of mechanics to position themselves beneath a vehicle which appears to be straining the lift to or beyond its capacity.

Thus, although a lift of the type described may have a nominal maximum load rating of 4,000 lbs., for example, mechanics will often not feel comfortable, or in fact will refuse to, work under a load of, for example, 2,500 lbs. on a 4,000 lbs. rated lift. This uncomfortable feeling develops from seeing the deflection of the forks, which is clearly visible. Thus, although the forks may take 15,000 or even 16,000 lbs. without failing, the apprehension of the mechanics takes place well within the rated load of the lift.

Accordingly, it has been discovered that the apprehension of these mechanics can be allayed by arranging a lift such that, in effect, it "leans back" or away from the direction of the load when the load is raised from the ground. In other words, this "leaning back" causes the outer ends of the fork legs to be gradually raised relative to the inner ends thereof as the lift frame passes through the curved section of the mast. Thus, under relatively heavy loads, the outer ends of the fork legs still appear to undergo little or no net deflection. This is because, as the load is tipped rearward, the apparent center of gravity of the load moves toward the rear and toward the supporting structure. This enables the supporting structure to share a greater portion of the load by reducing the effective overhanging or cantilevered force. Consequently, both the force and the leverage are decreased in respect to what they would otherwise be.

In this connection, for example, a preferred form of the invention calls for a pair of masts on the main frame to be bent or "pre-curved" through an angle totaling some 5°, preferably starting out with a negative angle of −1° and working from there through the angle of 5°. Thus, there is a net "lean back" angle of about 4°. The curvature of the mast preferably is localized to a center section, such that two straight portions or elements are separated by a curved portion. Preferably, the masts are mounted such that 1° is seen in the initial inclination of the mast towards the work or load, and the final angle of the second portion is 5°, leaving a net angle of 4° back from a true vertical.

Of course, other amounts of curvature, as well as the location and length of the optionally but preferably included two straight legs of the curved or bent mast may vary somewhat within the scope of the invention. A deflection totaling some 5° has proven most satisfactory for those applications in which it has been used. In another embodiment, a straight mast is used, with the mast being inclined at constant angle. This usually requires a mechanism to enable the forks to lie flat on the ground initially, and to assume a backward tilt as soon as they achieve substantial height.

In view of the failure of the prior art to provide a lift having at least one mast structure with a "backward lean" built into it, it is an object of the invention to provide a lift having at least one mast forming either all or a part of the main frame, with the mast having at least one curved portion leaning away from the direction of the load.

It is another object of the invention to provide a service lift with not only an improved capability for lifting loads, but also one which appears to the user to be much safer, particularly while lifting heavy loads.

Yet another object of the invention is to provide a service lift having a main frame with an optional longitudinal member and a pair of support legs extending transversely thereof, with such a main frame further including at least one mast preferably having a gradual curve therein, and most preferably having a curved section with straight elements lying to either side of the curved section.

Still another object of the invention is to provide a main frame with two channel-shaped masts each having curved sections flanked by two straight sections.

A further object of the invention is to provide a lift frame which cooperates with the curved masts including forks which move generally vertically under a force applied by a hydraulic or equivalent lifting mechanism.

A still further object of the invention is to provide a lift frame which includes a fork or a pair of forks with their legs extending initially outwardly and generally parallel to the support legs for the frame, and which forks legs are adapted to have their outer ends move up relative to their inner ends as the forks are raised.

An additional object of the invention is to provide a service lift with a lifting mechanism including components which are inherently capable of accommodating the slightly curved mast that the carriage of the lift frame follows as it moves up and down throughout its entire range of travel.

Another object of the invention is to provide an improved fork lift such as that described which optionally uses a hydraulic cylinder and flexible chains to apply its lifting force to the lift frame.

Yet another object of the invention is to provide a lift frame having a carriage with portions that move within two channels forming parts of the curved or inclined masts.

Still another object of the invention is to provide a service lift with a lift frame supported by a carriage having mast followers, such as rollers, skids, or the like, which are capable of remaining stabilized within the flanges of the mast as the lift frame moves through a path including curvilinear portions from the bottom to the top of the mast.

A further object of the invention is to provide a mast unit having appropriately shaped receptors for the rollers or the equivalent on the carriage of the lift frame, with such rollers or the like being arranged so as to closely track the profile of the mast unit.

A still further object of the invention is to provide a service lift which will not engender feelings of apprehension or refusal to work by mechanics called upon to position themselves under the forks of the lift, even when it is heavily loaded.

Another object of the invention is to provide a lifting unit wherein the masts are affixed to the walls of a building structure, to obviate the necessity of the remainder of the main frame.

A further object of the invention is to provide a lifting unit wherein the masts are straight but inclined rearwardly so that the carriage of the lift frame gradually undergoes a rearward movement as it rises, thereby inclining the lift fork or forks upwardly at their end portions and leaving them raised at all but the lowermost portion of their travel.

A still further object of the invention is to provide a straight-masted rear-tilted lift unit as described, wherein the carriage undergoes a pivoting or like movement near the bottom of its travel.

These and other objects of the present invention are achieved in practice by providing, in one embodiment, an improved lift assembly including a main frame having a longitudinally extending member, a pair of transverse support leg members, and a mast extending substantially vertically in use, a lift frame including a fork assembly, at least one carriage forming a part of the lift frame and a lifting mechanism for the lift frame, with the mast including a curved portion that extends in use generally away from the lateral direction in which the support legs extend. In another embodiment, a straight but inclined mast is employed, with the same net result of having the lift frame tilt backwards and positioning the load more over the main frame.

The manner in which these and other objects and advantages of the invention are achieved in practice will become more clearly apparent when reference is made to the a description of the preferred embodiments of the invention set forth by way of example and shown in the accompanying drawings in which like reference numbers indicate corresponding parts throughout.

DESCRIPTION OF THE PREFERRED EMBODIMENTS OF THE INVENTION

Figure 1:
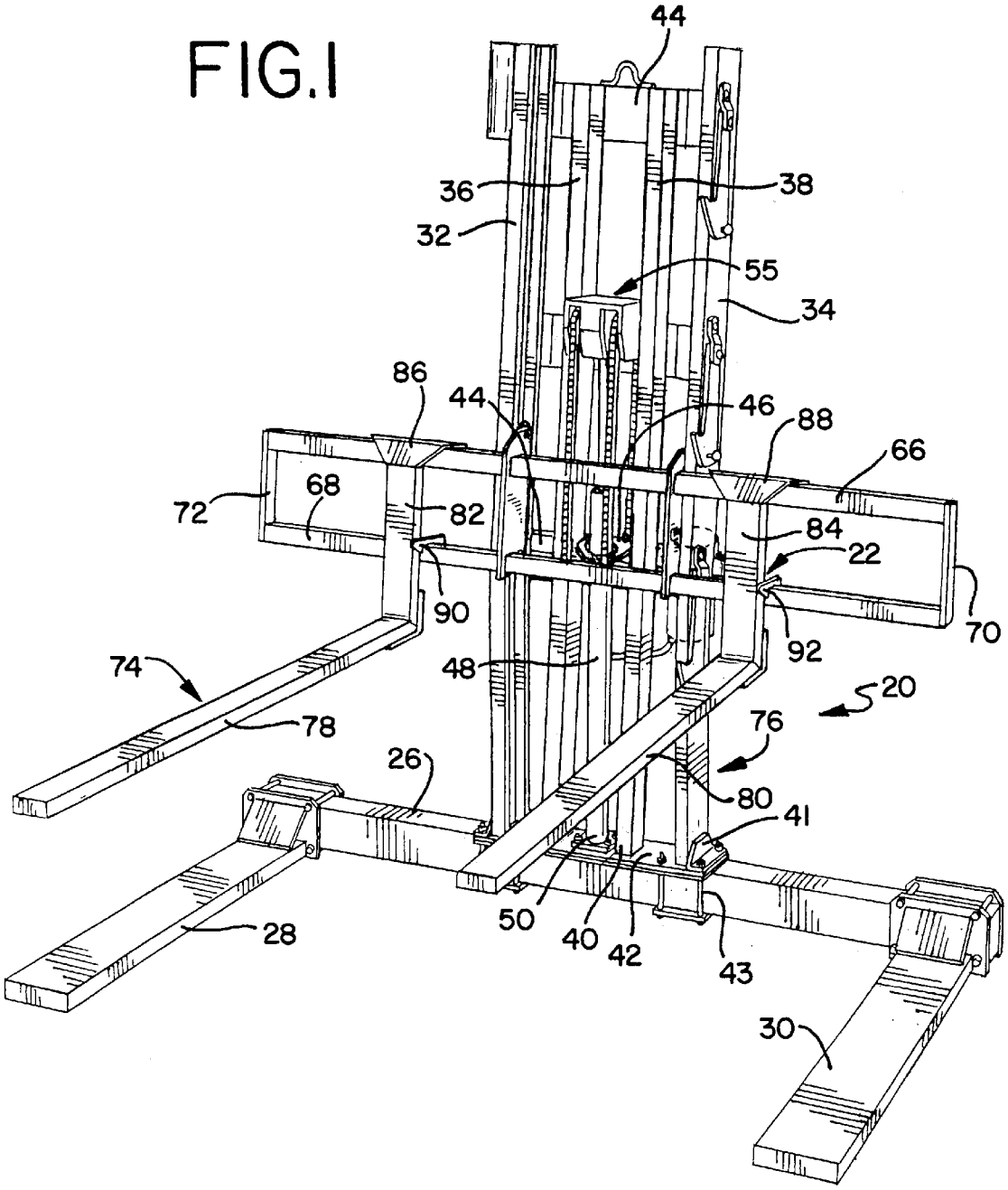
FIG. 1 is a perspective view of the service lift of the present invention.

While the invention may be embodied in a number of forms, and may serve purposes in addition to those specifically enumerated here, a description will be given of two preferred embodiments using two masts of particular configurations, and a lift frame, preferably also having two forks lifted by a hydraulic/chain or equivalent mechanism, such as a ball screw device or pneumatic cylinder.

Referring now to the drawings in greater detail, in its preferred form, the service lift 18 of the invention comprises three principal elements. These are a main frame generally designated 20, a lift frame generally designated 22 and a hydraulic cylinder/chain lifting mechanism generally designated 24, a part of which is stationary and a part of which is movable with the lift frame.

The main frame 20 illustrated includes a longitudinal element 26 and a pair of support legs 28, 30 extending generally transversely of the element 26 in the form of a beam or tube. Attached to the longitudinal element 26 are left- and right-hand mast members 32, 34, of a desired shape or profile which is very important to an embodiment of the invention. In this connection, the expression "longitudinal" is taken to mean along the same axis as the longitudinal axis of the vehicle normally being serviced, and "lateral" means laterally of such vehicle. "Front" means toward the vehicle being lifted and "rear" or "backward" means toward the frame.

Figure 2:
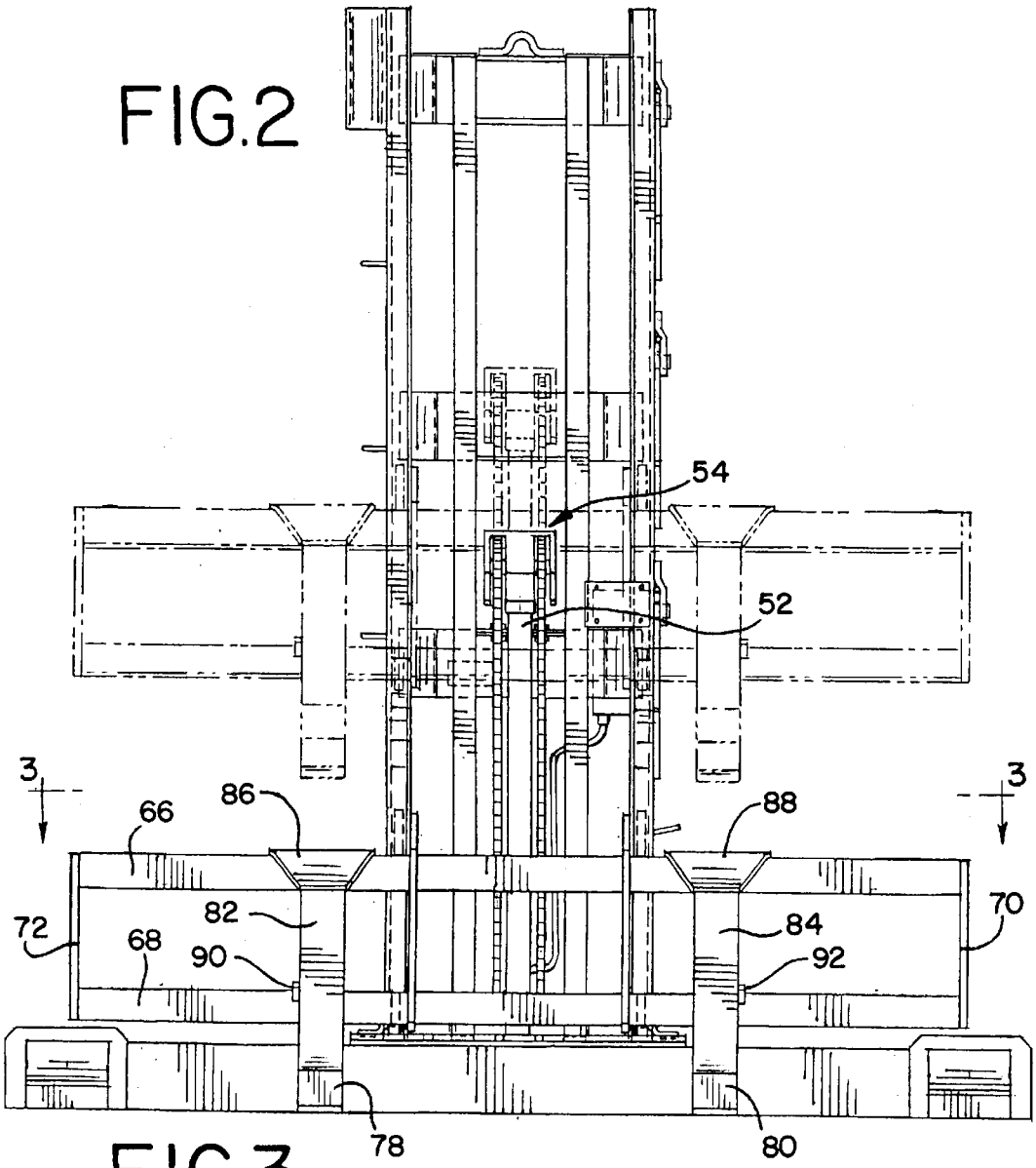
FIG. 2 is a front elevational view of the service lift of the invention, showing the lift frame in its downwardmost position of use, and showing the lift frame in an intermediate position of use in phantom lines.
Figure 3:
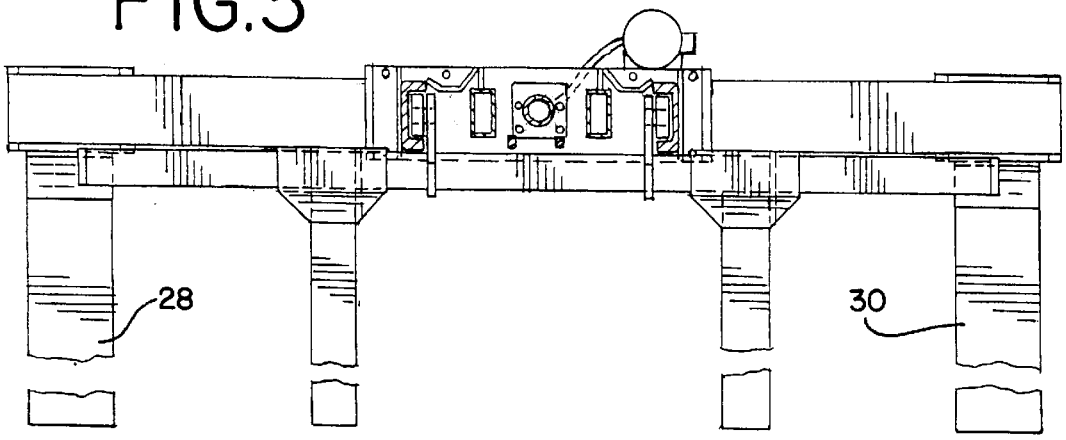
FIG. 3 is a horizontal sectional view, with portions broken away, taken along lines 3—3 of FIG. 2 and showing the details of the masts, the carriage, the frame stiffeners and the operating cylinder and reservoir.

As shown in FIGS. 1–3, the main frame also optionally includes a pair of auxiliary or stiffening frame elements 36, 38 which extend vertically. These elements are welded at their lower ends 40 (one side shown only for clarity) to a mounting plate 42 carried atop the longitudinal element 26. The preferred method of mounting the mast members 32, 34 to the longitudinal element 26 is by first welding their lower ends to the plate 42. The stiffeners 36, 38 are also welded to the plate 42, along with the flanges 41. The plate 42 is fastened to the frame element 26 by bolts or other fasteners 43.

Several cross tie elements 44 are spaced apart vertically on the masts 32, 34 to help stabilize them. One flange 46 on the cross member 44 (FIG. 6) surrounds an upper portion of a hydraulic cylinder 48 and secures it against lateral movement. The cylinder 48 is affixed at its lower end portion 50 (FIG. 1) to the bottom plate 42.

A rod 52 is reciprocable within the hydraulic cylinder 48, and the rod carries with it a dual sprocket carrier assembly generally designated 54 which serves to raise the lift frame 22 in a manner to be described in detail later.

Referring now to the lift frame generally designated 22, this unit is shown to include upper and lower longitudinally extending members 66, 68, right- and left-hand, end plates 70, 72, and laterally extending, left- and right-hand fork legs generally designated 74, 76. Each fork is adjustable along the length of the members 66, 68 and includes laterally extending lower legs 78, 80 and vertically extending support legs 82, 84.

The vertically extending support legs 82, 84 each includes a load spreading top attachment in the form of a contoured plate 86, 88 and one or more drop-down locks 90, 92 that secure the legs 82, 84 to the lower member 68. The laterally extending legs 78, 80 of the forks 74, 76 may have attached to them a variety of devices such as wheel-receiving cups or the like (not shown), and the fork legs 78, 80 may also have removably mounted to them additional vertical support members for various parts of the supported load. However, it is understood that these form parts of the invention which are known to those skilled in the art, and not forming a part of the invention which is novel per se, a drawing and description of them is omitted for clarity.

Figure 6:
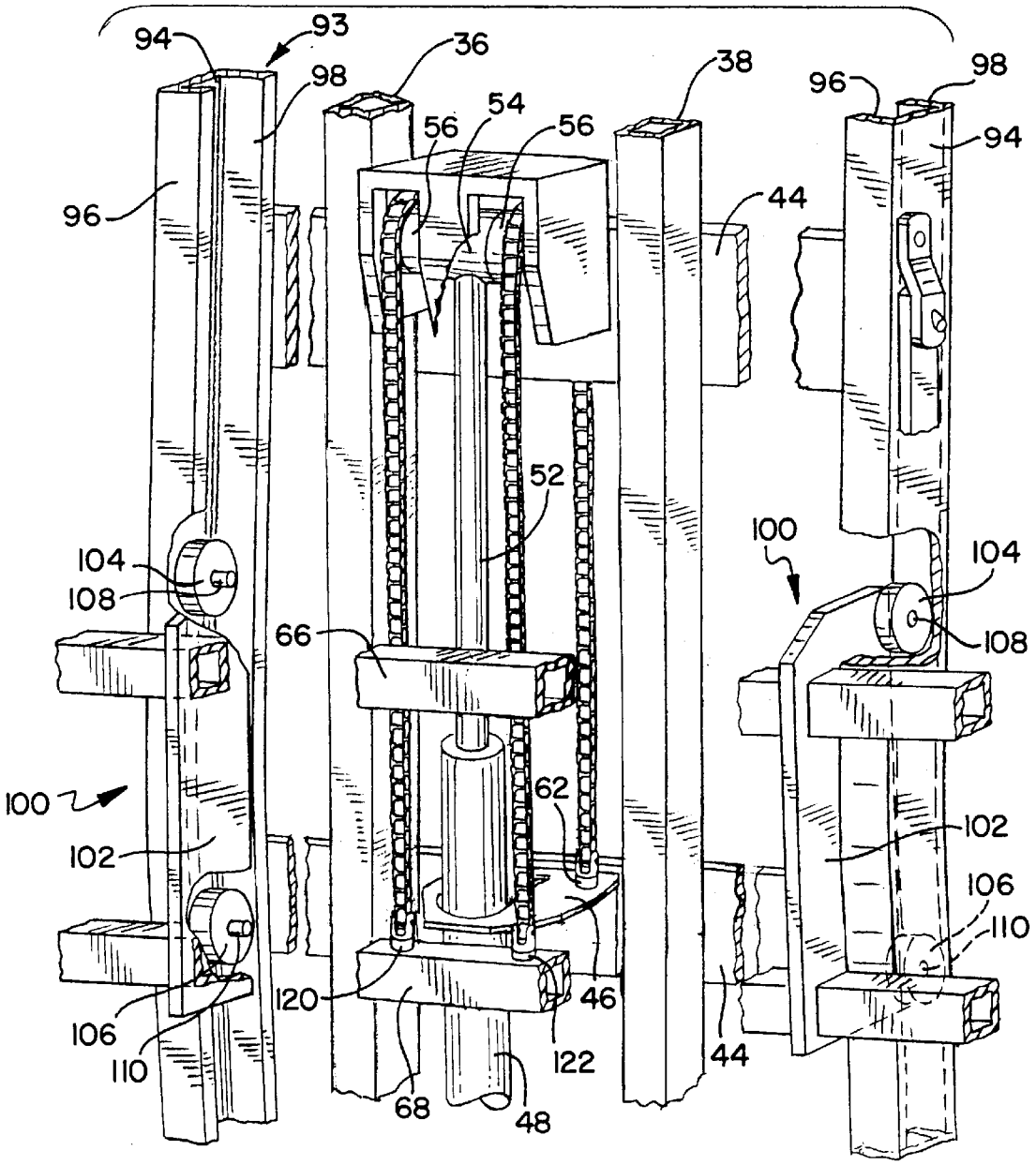
FIG. 6 is an enlarged perspective view, with portions broken away, showing portions of the masts, portion of the carriage of the lift frame and certain elements of the preferred hydraulic/mechanical lift mechanism of the invention; and, FIG. 7 is a fragmentary side elevational view of a modified form of the invention, showing a straight but inclined mast.

Referring now to a part of the invention which is essential in this embodiment, the mast members 32, 34 are shown to have means for guiding a carriage with which they cooperate. Preferably, these means in the masts are in the form of channels generally designated 93, each of which has a center section 94 and two opposed flanges 96, 98. (FIG. 6).

Confined within each track formed by the mast is an associated carriage assembly generally designated 100. Each carriage assembly includes a frame plate 102 that extends between upper and lower longitudinal members 66, 68. The frame plate 102 carries upper and lower rollers 104, 106 journalled by their stub axles 108, 110. The rollers 104, 106 ride snugly within the channels 93 on each of the two masts 32, 34. Because the frame plates 102 are welded or otherwise fastened to the longitudinal members 66, 68, the rollers 104, 106 are captive and remain in their channels as they undergo a curvilinear motion along the track of the masts 32, 34.

Figure 5:
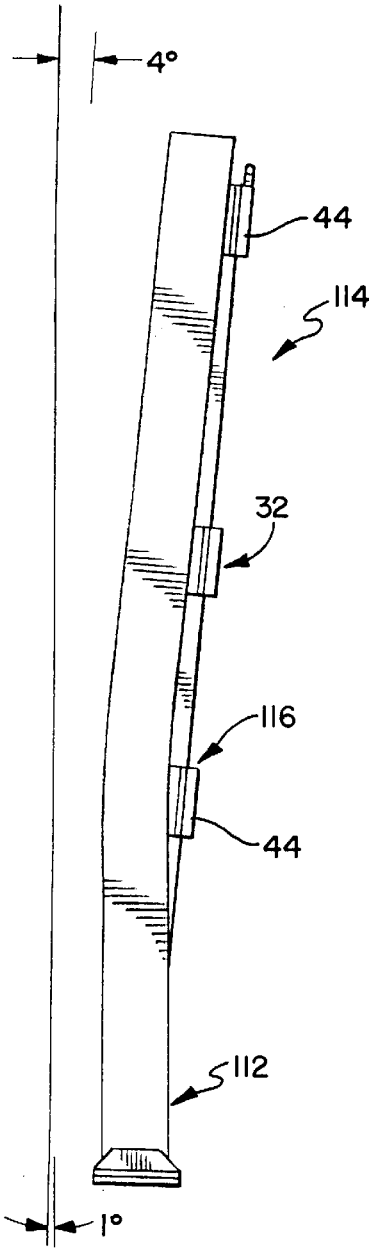
FIG. 5 is a side elevational view showing the configuration of one mast unit of the present invention.

One presently preferred form of curvature of these masts, which are an important feature of the invention is best shown, for example, in FIG. 5. Here, it is shown that each mast 32, 34 has three principal regions. The first is a lower (in position of use) region generally designated 112, which is essentially straight or orthoganal. The third region or section generally designated 114 is also substantially straight. The second or intermediate section or region generally designated 116 is bent so as to undergo a gradual curvature. Its two end portions subtend an included angle of about 5° between them.

Preferably, the curved section 116 has a radius of curvature of approximately 220 inches. In other words, This bend is such that, within a length of about 18 inches, it amounts to some 5°. Both the left-hand and the right-hand masts 32, 34 have an equal bend, and this bend is imparted to the mast members in such a way that the two flanges 96, 98 remain the same distance apart throughout the bend and are free from buckling or the like. Preferably, the straight section 112 is about 19–20 inches long, the bend itself (section 116) is about 18 inches in length, and the remainder of the mast comprises section 114 which is about 53–54 inches in length in one embodiment.

The installation of the mast relative to the longitudinal beam 26 is preferably such that the masts are inclined toward the load side of the unit by an inclination of about 1°. Consequently, with the mast bend aggregating 5°, the net angle of the upper section of the mast toward the rear from the vertical is about 4°. The flanges of the mast track are free from bulges or buckling or any sort, with the result that the carriage wheels may traverse the track without binding, and yet the carriage rides within the flanges without any undue play or the like. The 5° total bend and the 1° initial inclination toward the load are merely illustrative values which have worked well in practice. Various other values, from 1° up to 10° or more are believed to be effective. The 1° inclination toward the load can be important, because it allows the fork legs to lie virtually flat on the ground. This makes loading them easy, because the fork legs are as low as possible. Normally, a vehicle approaches moving parallel to the longitudinal extent of main frame, and then its front wheels pass over the fork legs 74, 76.

Figure 4:
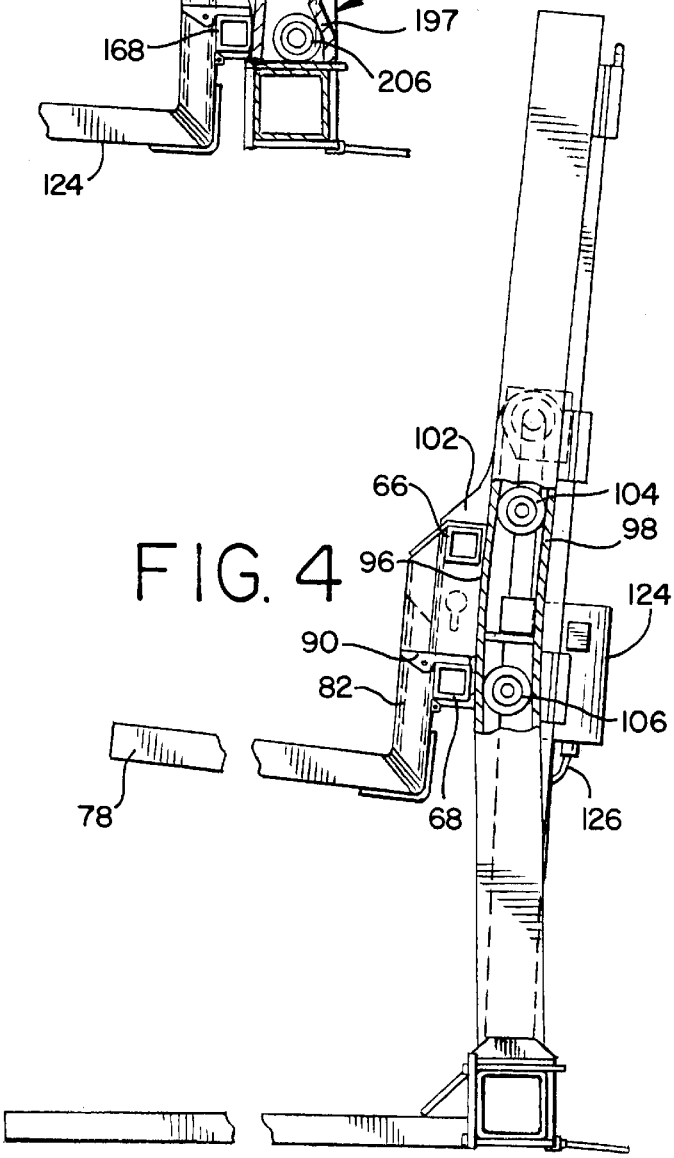
FIG. 4 is a side elevational view, with portions broken away, showing the main frame of the invention, including the mast, the lift frame and portions of the carriage.

FIG. 6 also best shows some additional details of the sprocket carrier or cross-yoke 54, which is normally somewhat shielded by the cover 55. The sprocket carrier 54 moves up and down with the rod 52, and two sprockets or pulleys 56 are mounted thereon. Because the fixed ends of the chain 62 are attached to the cross member 46, and the running ends 120, 122 are attached to longitudinal member 68, when the elongated hydraulic rod 52 moves up and down, the carrier 54 moves with it, carrying the lift frame. A reservoir 124 (FIG. 4) for the cylinder is shown to include a line 126 which supplies the cylinder 48 with pressurized fluid by way of a hydraulic pump (not shown).

In use, a load is simply placed on the forks, whose ends lie substantially flat on the floor, with their far ends close to touching the floor and their inner ends sometimes being slightly spaced apart therefrom. When the load is lifted, the lift frame 22 follows the path established by the masts 32, 34. As a result, the outer end portions of the forks 78, 80 are gradually raised above a level position, assuming the load is relatively light. As the load becomes heavier, the fork legs deflect downwardly somewhat, but with a net backward inclination of, for example, 4°, these fork legs do not deflect visibly to or past a horizontal position in most cases. This creates the appearance of safety in handling the applied loads and eases or eliminates the apprehension of service personnel working under the lift.

An embodiment has been described wherein two masts are used, and wherein the carriage for the lift frame comprises two sets of rollers or wheels operating within the track set by the flanges of the mast. However, it is also conceivable that a single mast could be used, in which case the beam could be flanged in such a way as to have rollers on both sides thereof. While not preferred, this form of the invention could be manufactured, especially where there would not be a great deal of side load or twisting imparted to the mast.

A pair of rollers on each carriage assembly has been shown, and these rollers are preferred for ease in traversing the path established by the mast flanges. However, it would be possible for the rollers to be replaced with skids or the like, using greased ways or the like to reduce friction. This obviously has some disadvantages but could afford a construction that would also fall within the scope of the invention. A hydraulic lift has been shown, but other types of lifts could be used if there were some reason to do so, such as a ball screw type jack. A pneumatic lift might also be used, for example.

The mast shape illustrated is one preferred form of the present invention. However, the mast could be curved throughout its extent, or could have varying degrees of curvature in different sections of the mast. In the alternative, it could include one straight element at the end of a curved section. An embodiment has been shown wherein the mast is slightly tilted towards the load at the lower end of the mast, with a net backward curve being achieved by a combination of a curved mast and a straight mast. However, the initial inclination of the mast could be straight or even backward, depending on the application.

Figure 7:
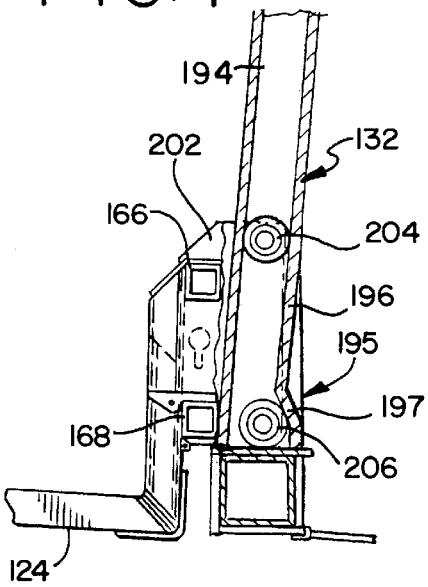

FIG. 7 shows an embodiment of the invention wherein the mast is straight but inclined. In this embodiment, which will be illustrated merely by showing a portion of one mast generally designated 132, the entire mast 132 is straight but it is inclined slightly towards the rear or away from the load. The other elements of the invention, such as the longitudinal members 166, 168 are the same, as are the carriage frame plate 202. In this example, the rollers 204, 206 track between the flanges 198, 196 and within the center section 194 of the channel 193. The main difference is that, at the bottom of the channel 193, there is a pocket or recess 195 that allows the lower roller 206 to move to the right as shown in FIG. 7 when the carriage frame plate 202 is in its lowermost position. This in turn allows the lower fork leg 174 to move downward, approximately parallel to the floor. When the unit is lifted slightly, the contoured rear transition portion 197 of the rear flange 198 causes the roller 206 to move forward or toward the other flange 196 and eventually become centered in the channel 194 as the carriage moves upward. Thereafter, the carriage continues to move slightly to the rear in keeping with its inclined character, finally achieving a position which varies between several inches and a foot or more to the rear of the position occupied by the carriage frame 202, in its lowermost position.

This embodiment illustrates the effect of a backward leaning mast which is achieved other than by curvature, and still allows the fork to lie on or about the floor. In this embodiment, like the others, the higher the load is lifted, the more it moves to the rear, thus decreasing the cantilevered strain on the load being lifted as a whole.

In another embodiment, the invention also achieves its advantages and objects by mounting the channels, etc. against the wall or the like, assuming a suitable wall can be found. This does away with the need for that portion of the main frame which resides in the members 28, 30 and the lower tube 26 and its associated parts.

Several preferred embodiments of the invention having been described, it is anticipated that modifications and variations to the invention will occur to those skilled in the art and is anticipated that such modifications and variations may be made without departing from the spirit of the invention or the scope of the appended claims.

What is claimed is:

1. A lift assembly for use in a repair shop or the like, said assembly having a relatively fixed component including at least one mast extending generally vertically in position of use and having a portion defining a mast track and a relatively movable component including a lift frame assembly mounted for generally vertical movement, said lift frame assembly comprising at least one longitudinal member, at least one work-engaging member having a portion extending generally outwardly and approximately perpendicular to said mast, a portion including an upward extension member secured to said at least one longitudinal member, and a lifting assembly including a vertically movable element, said lift frame being movably secured to said mast by at least one guide assembly adapted to move substantially vertically along said track of said mast, said mast including a portion with a slight curve in the direction away from said work-engaging member, said curved mast allowing free but confined movement of said guide assembly as said lift frame travels throughout a range of vertical positions.

2. A lift assembly as defined in claim 1 which further includes, as said relatively fixed component, a base member and a pair of support legs extending laterally in one direction from said base member, and wherein said at least one longitudinal member of said lift frame includes two longitudinally extending members, wherein said at least one work-engaging member of said lift frame assembly includes a pair of work-engaging members in the form of fork tines, and wherein said at least one mast comprises two masts.

3. A lift assembly as defined in claim 2 wherein each of said guide assemblies comprises a frame portion secured to said longitudinal members, and a pair of rollers mounted on said frame portions, each pair of said rollers being adapted to move within one channel formed in one of said masts.

4. A lift assembly as defined in claim 2 wherein each of said masts includes, in addition to said portion with said slight curve therein, at least one straight portion.

5. A lift assembly as defined in claim 2 wherein each of said masts includes, in addition to said portion with said slight curve, a pair of straight portions each joined at one of its ends to said curved portion, whereby said curved portion lies between said straight portions.

6. A lift assembly as defined in claim 2 wherein said masts each includes a lowermost portion that is inclined very slightly from the vertical toward the support legs of said relatively fixed component.

7. A lift assembly as defined in claim 2 wherein said masts each include a pair of straight portions on either end of said slightly curved portion, said curved portion bending away from said support legs by at least three degrees.

8. A lift assembly as defined in claim 2 wherein each of said masts includes two straight sections joined to said curved portions, two of said mast straight sections being inclined towards said support legs by an angle of approximately one degree and two of said other of said mast straight sections being inclined away from said support legs by approximately five degrees.

9. A lift assembly as defined in claim 2 wherein said vertically movable lifting element comprises a rod movable within a hydraulic cylinder, chains and a carrier for said chains thereon, said chains being anchored to a cross brace for said cylinder on the fixed ends of said chains and anchored on their movable ends to the lower one of said longitudinally extending members.

10. A lift assembly as defined in claim 1 which further includes a pair of auxiliary frame members extending generally parallel to said masts, and braces extending longitudinally outwardly from said auxiliary frame members and securing said auxiliary frame members to said masts.

11. A lift assembly for use in a repair shop or the like, said assembly including a pair of masts extending generally vertically, said masts each being in the form of a channel having a center section and two opposed flange sections, a lift frame including at least one horizontally extending member adapted to carry a load and at least one vertical member extending transversely of said horizontal member, said lift frame being arranged for vertical movement along the path of said masts by a pair of guide assemblies each including a pair of mast-following units spaced vertically apart, said masts each including a slightly curved section therein, said curve being constructed and arranged so as, in its upper regions, to be inclined in the direction away from said load, and a hydraulic lifting mechanism adapted to engage said lift frame and a load contained thereon and move said load vertically by moving said guide assemblies that are confined by said flanges of said masts.

12. A lift assembly as defined in claim 11 wherein said assembly further includes a longitudinally extending base member and a pair of spaced apart support legs extending laterally therefrom in a first direction, wherein said at least one horizontally extending member on said lift frame comprises two spaced apart horizontally extending members, and wherein said at least one vertical member comprises two vertical members.

13. A lift assembly for use in a repair shop or the like, said assembly having a relatively fixed component including a base element, a pair of spaced apart support legs extending laterally in one direction from said base element, and at least one mast extending generally vertically in position of use from said base element, a relatively movable component including a lift frame assembly mounted for generally vertical movement, said lift frame assembly comprising at least one longitudinally extending member, and a work-engaging member extending generally laterally and approximately parallel to said support legs, and a vertically movable lifting unit having a fixed element and a movable element, said lift frame being secured to said mast by at least one guide assembly adapted to move vertically along the track of said mast, said mast having at least a portion undergoing a gradual curve and positioned so as to extend away from the direction of said support legs.

14. A lift assembly for use in a repair shop or the like, said assembly having a relatively fixed component including at least one straight mast extending generally vertically in position of use but slightly inclined in a direction away from the load, and a relatively movable component including a lift frame assembly mounted for generally vertical movement, said lift frame assembly comprising at least one longitudinal member, at least one work-engaging member having a portion extending generally outwardly and approximately perpendicular to said mast and a portion including an upward extension member secured to said at least one longitudinal member, and a vertically movable lifting assembly including a movable element, said lift frame being movably secured to said mast by at least one guide assembly adapted to move substantially vertically along the track of said mast, said mast comprising a channel with a center section and opposed flanges, said mast having a base portion with a pocket in the rear flange portion thereon at the lower end thereof for accommodating a portion of said guide assembly, a transition surface above said pocket, said transition surface being inclined toward the center section of said mast as said mast rises, and said mast allowing vertically free but guided movement of said guide assembly as said lift frame travels vertically throughout a range of vertical positions, thereby moving said lift frame from a substantially horizontal position to a rearwardly inclined position as said guide assembly moves out of said pocket.

15. A lift assembly as defined in claim 14 wherein said at least one mast comprises two masts.

* * * * *